US010960442B2

(12) United States Patent
Hamilton

(10) Patent No.: US 10,960,442 B2
(45) Date of Patent: Mar. 30, 2021

(54) COATING LINE CLEANING APPARATUS

(71) Applicant: ITW LIMITED, Windsor (GB)

(72) Inventor: Sheila Hamilton, Strathclyde (GB)

(73) Assignee: ITW LIMITED, Windsor (GB)

( * ) Notice: Subject to any disclaimer, the term of this patent is extended or adjusted under 35 U.S.C. 154(b) by 165 days.

(21) Appl. No.: 15/519,260

(22) PCT Filed: Oct. 9, 2015

(86) PCT No.: PCT/IB2015/057740
§ 371 (c)(1),
(2) Date: Apr. 14, 2017

(87) PCT Pub. No.: WO2016/075564
PCT Pub. Date: May 19, 2016

(65) Prior Publication Data

US 2017/0239695 A1 Aug. 24, 2017

(30) Foreign Application Priority Data

Nov. 13, 2014 (GB) ..... 1420187

(51) Int. Cl.
*B08B 7/00* (2006.01)
*B08B 1/02* (2006.01)
*B41F 35/00* (2006.01)

(52) U.S. Cl.
CPC ..... *B08B 7/0028* (2013.01); *B08B 1/02* (2013.01); *B41F 35/00* (2013.01)

(58) Field of Classification Search
None
See application file for complete search history.

(56) References Cited

U.S. PATENT DOCUMENTS 3,781,107 A * 12/1973 Ruhland ..... G03G 21/0041 399/358
5,138,390 A * 8/1992 Miyabayashi ..... G03G 15/2025 15/256.51

(Continued)

FOREIGN PATENT DOCUMENTS

CN 101090776 A 12/2007
CN 201862537 U 6/2011

(Continued)

OTHER PUBLICATIONS

Notification of Transmittal of the International Search Report and the Written Opinion of the International Searching Authority from corresponding PCT/IB2015/057740 dated Jan. 21, 2016.

*Primary Examiner* — Jethro M. Pence
(74) *Attorney, Agent, or Firm* — Lando & Anastasi, LLP

(57) ABSTRACT

The invention relates to a coating line (1) cleaning apparatus (20) and a method for cleaning at least a selected part of a coating line. The coating line cleaning apparatus comprising a conveyed entity having first and second mutually opposed major faces and at least one flexible cleaning element (12) having first and second mutually opposed major faces, said cleaning element being characterised in that each one of said first (15) and second (11) major faces is tacky, the first of said tacky faces of said cleaning element being releasably adhered to one of the major faces (8) of the conveyed entity (4), and the second tacky major face of said cleaning element being temporarily contactable with the selected part (14) of the coating line to bring said second tacky major face (11) of the cleaning element into temporary contact with said selected part of a coating line to cause any contaminants present on said selected part (14) of a coating line (1) to adhere to said second tacky major face (11) of said cleaning (Continued)

element thereby causing any contaminants to be removed from said selected part of a coating line (1).

18 Claims, 4 Drawing Sheets

(56) References Cited

U.S. PATENT DOCUMENTS

| | | | | | |
|---|---|---|---|---|---|
| 5,367,982 | A | * | 11/1994 | DeMoore | B41F 31/027 101/350.6 |
| 2009/0208654 | A1 | | 8/2009 | MacFarlane | |

FOREIGN PATENT DOCUMENTS

| | | | |
|---|---|---|---|
| CN | 202671968 | U | 1/2013 |
| CN | 203875032 | U | 10/2014 |
| DE | 102005051763 | A1 | 5/2007 |
| EP | 0568397 | A1 | 11/1993 |

* cited by examiner

COATING LINE CLEANING APPARATUS

CROSS-REFERENCE TO RELATED APPLICATIONS

This application is a U.S. National Phase Application under 35 U.S.C. § 371 of International Application No. PCT/IB2015/057740, filed Oct. 9, 2015, titled COATING LINE CLEANING APPARATUS, which claims priority to United Kingdom Application No. GB 1420187.5, filed Nov. 13, 2014. These prior applications are incorporated by reference herein in their entirety.

The present invention relates to a coating line cleaning apparatus and a cleaning method for cleaning selected parts of a coating line. More particularly, though not exclusively, the present invention relates to a coating line cleaning apparatus and a cleaning method for cleaning the surface of at least one roller in a coating line.

Coating lines, such as those used in coating processes for example, are used in a wide range of applications to produce coated products and substrates such as, for example, laminates of paper, film and/or foils for use in a wide variety of end products. Products such as food packaging, photographic paper, optical devices, medical supplies or high technology coated webs are all formed in so called coating lines. Certain examples use so called roll-to-roll coating lines where a roll of continuous substrate material is unwound from a substrate roll into and through various stations within the coating line such as for example cleaning, coating and heating stations and then, following treatment through the coating line, is rewound at the outlet of the machine onto a final coated substrate roll. The substrate is generally pulled through the coating line by a pull roller system mounted proximate the rewinding element at the end of the coating line.

The substrate material must be supported during its passage through the coating line by supporting elements, typically in the form of rotatable rollers. Rotation of the rollers may be driven by the substrate as it is conveyed over the surface of the support rollers, the substrate itself being driven through the coating line by the pull rollers and, in certain coating lines, by supporting elements which themselves are driven, rotatable rollers within the coating line. Within a coating line the various support rollers are not, necessarily in alignment with one another. The alignment of the support rollers within the coating line is typically such that the substrate passing through the coating line moves in multiple planes.

A coating line is typically characterised by a number of rollers having a number of different surface materials and/or textures. For example, certain rollers within a coating line may have polymer surfaces, others may have ceramic surfaces, other rollers may have a surface of dimpled polytetrafluoroethylene (PTFE); other rollers are formed of chromed metal and others have an aluminium surface. Each roller surface will have unique properties and, more specifically, will have unique surface adhesion properties.

This invention has particular application to the cleaning of the selected parts of a coating line, in order to remove dust or other contaminants from the surface of the selected part which otherwise would be transferred on to substrate material being conveyed through the coating line over the surfaces of the rollers. When transporting a substrate through a coating line, it is essential that contaminants from the rollers are not transferred on to the roller-contacted surface(s) of the substrate material, thereby to prevent the contaminants adversely affecting the substrate material which would otherwise result in a defective end product of contaminated, coated substrate material. A known procedure for cleaning rollers within a coating line comprises manually wiping the rollers with a cloth, however this procedure necessitates gaining adequate access to the rollers, which may require, for example, that equipment incorporating the rollers be taken off-line and/or at least partially dismantled. At the very least, prior art coating line cleaning procedures extensively disrupt normal productive operations and are both time and labour intensive It is therefore an object of the present invention to provide a cleaning apparatus and a cleaning method for cleaning at least one selected part of a coating line which obviates or mitigates the disadvantages of the prior art.

It is an aim of the present invention to provide an in-line cleaning apparatus whereby the coating line need not be taken off line in order for cleaning to be undertaken.

It is a further aim to provide a coating line cleaner for cleaning of a roller system within a coating line whereby the line cleaner readily and easily adheres to the substrate material and is also readily removed therefrom following cleaning.

According to a first aspect of the present invention there is provided a coating line cleaning apparatus for cleaning at least a selected part of a coating line, comprising a conveyed entity having first and second mutually opposed major faces and at least one flexible cleaning element having first and second mutually opposed major faces, said cleaning element being characterised in that each one of said first and second major faces is tacky, the first of said tacky faces of said cleaning element being releasably adhered to one of the major faces of the conveyed entity, and the second tacky major face of said cleaning element being temporarily contactable with the selected part of the coating line to bring said second tacky major face of the cleaning element into temporary contact with said selected part of a coating line to cause any contaminants present on said selected part of a coating line to adhere to said second tacky major face of said cleaning element thereby causing any contaminants to be removed from said selected part of a coating line.

Preferably the cleaning element is releasably adhered to the conveyed entity by adhesion forces. More specifically, the cleaning element is releasably adhered to the conveyed entity by surface adhesion forces. That is to say, there is no adhesive material on or between the cleaning element and the conveyed entity. The cleaning element is releasably adhered to the conveyed entity solely by surface adhesion forces. In use of the cleaning apparatus in an operational coating line, a cleaning element may be positioned on either or both sides of the conveyed entity which may be conveyed through multiple planes throughout the coating line without risk of the cleaning element and the conveyed entity becoming detached from one another.

Preferably, the surface adhesion forces between the first tacky surface of the cleaning element and the major face of the conveyed entity are greater than the surface adhesion forces between the second tacky surface of the cleaning element and the selected part of the coating line. In this way, the cleaning element remains adhered to the conveyed entity whilst not sticking to the selected part of the coating line being cleaned of contaminants.

Most preferably, the surface adhesion forces between the first tacky surface of the cleaning element and the major face of the conveyed entity are greater than the surface adhesion forces between the second tacky surface of the cleaning element and any selected part of the coating line to be cleaned by the cleaning apparatus. In this way, the cleaning element remains adhered to the conveyed entity whilst not sticking to any selected part of the coating line being cleaned of contaminants.

The tacky characteristic of the first and second major faces of the cleaning element is provided by the surface adhesion properties of the material of the first and second major faces of the cleaning element.

The surface adhesion properties of the second tacky face of the cleaning element are sufficient to overcome the adhesion forces between the contaminants and the selected part of the coating line to be cleaned and therefore to collect and/or remove the contaminants from the selected part of the coating line to be cleaned onto the second tacky face of the cleaning element, whilst being insufficient to cause the surface of the selected part of the coating line to be cleaned to adhere to the second tacky face of the cleaning element.

Preferably the surface adhesion properties of the first and second tacky surfaces of the cleaning element are provided by one or more of mechanical adhesion forces, chemical adhesion forces, shore hardness and/or electrical adhesion forces.

The mechanical adhesion forces may be provided by surface roughness of the first and/or the second tacky surfaces of the cleaning element.

The second tacky surface of the cleaning element may also be electrostatically charged to assist in the collection and/or removal of the contaminating particles from a selected part of the coating line.

The cleaning element may be made from any suitable material. For example, the cleaning element may be made from or comprise elastomer material.

More specifically, the cleaning element may be made from or comprise polyurethane and/or a silicon-based polymer.

Alternatively, the cleaning element may be formed of a silicon-free polymer.

Alternatively, the cleaning element may be formed of a hydrogel or an isoprene polymer. In certain embodiments, the cleaning element may be formed of polyvinylchloride (PVC) polymer.

The chemical composition of the first and/or second tacky surfaces of the cleaning element may be modified to modify the chemical adhesion forces of the, or each, tacky surface.

The adhesion forces of the first and/or the tacky surfaces of the cleaning element due to chemical forces may be changed by modifying the chemical composition of the material forming the cleaning element. Suitable chemical modifiers include filler materials, for example. In certain embodiments, the filler material comprises a calcium carbonate. Thus, in certain embodiments the cleaning element comprises an elastomer containing a filler material whereby the filler material alters the chemical adhesion forces of the first and/or the second tacky surfaces of the cleaning element.

The shore hardness of the the cleaning element may be modified to assist in the collection and/or removal of the contaminating particles from the surfaces of at least one selected part of a coating line.

Shore hardness, or the measure of the resistance of a material to permanent indentation, is a term and physical property well known in the art and measured using a durometer.

In embodiments wherein the cleaning element is or comprises an elastomer material, factors influencing and modifying shore hardness include the number of chemical bonds in the material, the length of those chemical bonds and the tightness of those chemical bonds. It will be readily understood be the skilled artisan that a greater number of bonds and/or chemical bonds of shorter length and/or chemical bonds with greater chemical tightness are all properties which increase the shore hardness of a surface formed from or comprising an elastomer material.

The conveyed entity may comprise a flexible substrate material. More specifically, the substrate material is a web of flexible material. In such embodiments, the first and second major faces of the conveyed entity will be the first and second mutually opposing surfaces of the web of flexible material.

It is much by preference that the cleaning element is releasably adhered to a portion of the conveyed entity. More specifically, the cleaning element is releasably adhered to a major face of the conveyed entity proximate the leading edge of the conveyed entity. Alternatively, or in addition, a cleaning element is releasably adhered to a major face of the conveyed entity remote from the leading edge of the conveyed entity.

In certain embodiments, the cleaning element is releasably adhered to a portion of the first major face of the conveyed entity.

Alternatively, the cleaning element is releasably adhered to a portion of the second major face of the conveyed entity.

In certain embodiments, a cleaning element is releasably adhered to a portion of the first major face of the conveyed entity and a further cleaning element is releasably adhered to a portion of the second major face of the conveyed entity.

By adhering a cleaning element to the first and second major faces of the conveyed entity, surfaces within the coating line contacting either the first or the second major faces of the conveyed entity will be contacted by a cleaning element as the cleaning apparatus progresses through the coating line. In this way, any surface of the coating line contacting the cleaning apparatus will be cleaned by the cleaning apparatus.

The cleaning element is preferably a sheeted material. More specifically, the cleaning element comprises one or more sheets of material.

In the cleaning apparatus, the, or each cleaning element is releasably adhered to and is supported by the conveyed entity.

In certain embodiments, the selected part of the coating line comprises a supporting surface of at least one supporting element. More specifically, the at least one supporting element may be a rotatable roller. Even more specifically, the at least one supporting element may be a rotatable roller which is rotated when the cleaning apparatus is conveyed over the surface of the rotatable roller.

In certain embodiments, the selected part of a coating line comprises a supporting surface of each of a plurality of supporting rollers. More specifically, the plurality of rollers is arranged in series through the coating line.

When the at least one supporting element comprises a plurality of rollers, each of the rollers may be the same or, alternatively, may be a different diameter.

The, or each, selected part of the coating line may be formed of different materials. More specifically, the, or each, selected part of the coating line may have a unique surface depending on its function within the coating line. Each of the different materials of the, or each, selected part of the coating line has associated surface adhesion force(s). It is much by preference that the surface adhesion force(s) between the first tacky face of the cleaning element and the major face of the conveyed entity to which it is releasably adhered is greater than the or each of the surface adhesion force(s) between the second tacky face of the cleaning element and the, or each, of the surface(s) of the selected part of the coating line. In this way, the cleaning element and the conveyed entity will remain adhered to one another as the cleaning apparatus passes through the coating line.

It is much by preference that the surface adhesion forces between the second tacky face of the cleaning element and the contaminants to be removed from the selected part of the coating line are greater than the surface adhesion forces between the contaminants and the, or each, of the surface(s) of the selected part of the coating line. In this way, the contaminants will be removed from the, or each, of the surface(s) of the selected part of the coating line as the cleaning apparatus passes through the coating line.

According to a second aspect of the present invention there is provided a coating line cleaning apparatus for cleaning at least a selected part of a coating line, said coating line comprising at least one rotatable supporting element, said at least one rotatable supporting element comprising at least one supporting surface contactable with a conveyed entity in use of said coating line to support said conveyed entity as it is conveyed in a conveying direction through said coating line, said at least one supporting surface constituting said selected part of said coating line, said cleaning apparatus comprising a conveyed entity having first and second mutually opposed major faces and at least one flexible cleaning element having first and second mutually opposed major faces, said cleaning element being characterised in that at each one of said first and second major faces is tacky, the first of said tacky faces of the cleaning element being releasably adhered to one of the major faces of the conveyed entity, and the second of said tacky major faces of the cleaning element being temporarily contactable with said at least one supporting element to bring said second tacky major face of said at least one flexible cleaning element into temporary contact with said at least one supporting surface of said at least one rotatable supporting element during use of said cleaning apparatus to cause any contaminants present on said at least one supporting surface to adhere to said second tacky major face of said at least one flexible cleaning element and to cause any so-adhered contaminants to be removed with said at least one flexible cleaning element at the cessation of said temporary contact of said at least one cleaning element with said at least one supporting element whereby to clean at least said selected part of said coating line.

The coating line cleaning apparatus of the second aspect of the invention may have one or more of the features of the coating line cleaning apparatus of the first aspect of the invention.

In use of the coating line cleaning apparatus according to the first or the second aspects of the invention, the conveyed entity and the cleaning element are retained in intimate contact with one another as the cleaning apparatus is conveyed through the coating line.

A cleaning element may be placed into releasable contact with any portion of a conveyed entity to be passed through a coating line. One or more cleaning elements may, in certain embodiments, be placed into releasable contact with a first and/or a second major face of the conveyed entity proximate a leading edge of the conveyed entity. Alternatively, or in addition, one or more cleaning elements may be placed into releasable contact with a portion of the first and/or the second major face of a conveyed entity at any position along its length. In such embodiments, the cleaning apparatus will be passed through a coating line which is in the process of coating a conveyed entity by placing one or more cleaning elements into releasable contact with a portion of the first and/or the second major faces of the conveyed entity at any position along its length in order to cleaning the selected parts of the coating line without taking the coating line offline.

The at least one supporting surface may have a longitudinal dimension measured in said conveying direction, the cleaning apparatus being characterised in that the second tacky major face of the cleaning element has a longitudinal dimension not less than said longitudinal dimension of said at least one supporting surface.

In certain embodiments, the at least one supporting element is a conveyed entity-supporting roller having a peripheral surface constituting the at least one supporting surface, the peripheral surface of the roller having a circumferential dimension, the cleaning apparatus being further characterised in that the longitudinal dimension of the at least one cleaning element adhered to the conveyed entity is greater than said circumferential dimension. The coating line would normally comprise a plurality of such rollers disposed to be sequentially contacted by a conveyed entity being conveyed through the coating line. The plurality of rollers may be arranged in a single row, or may be arranged in two mutually generally parallel rows to pinch a conveyed entity therebetween. In addition, the coating line may comprise one or more rollers in offset alignment relative to one or more other rollers in the coating line.

The at least one supporting surface may have a transverse dimension measured transverse to said conveying direction, said at least one cleaning element of said cleaning apparatus may be rectangular in plan, said at least one cleaning element having a transverse dimension orthogonal to said longitudinal dimension of said at least one cleaning element, said transverse dimension of said at least one cleaning element preferably being less than said transverse dimension of said at least one supporting surface.

The at least one cleaning element may be homogeneous formed of a single material. The single material may be a tacky material such that the first and second major surfaces of the cleaning element have predetermined surface adhesion forces.

According to a third aspect of the present invention there is provided a cleaning method for cleaning at least a selected part of a coating line, said coating line comprising at least one supporting element, said at least one supporting element comprising at least one supporting surface contactable with a conveyed entity in use of said coating line to support said conveyed entity as it is conveyed in a conveying direction of said coating line, said at least one supporting surface constituting said selected part of said coating line, said method being characterised by the steps of providing a cleaning apparatus according to the first aspect or the second aspect of the present invention, releasably adhering a first major surface of the at least one cleaning element to a major face of the conveyed entity, temporarily contacting the second tacky major face of the at least one cleaning element of said cleaning apparatus with said at least one supporting surface of said coating line in a manner to cause said second major face of the cleaning element and said conveyed entity to progress in said conveying direction along substantially the full length of said at least one supporting surface and to cause any contaminants present on said at least one supporting surface to adhere to said second major face of the at least one cleaning element, and finally withdrawing said at least one cleaning element from said temporary contact with said at least one supporting element to cause any so-adhered contaminants to be removed with said at least one cleaning element whereby to clean at least said selected part of said coating system.

BRIEF DESCRIPTION OF THE DRAWINGS

Embodiments of the present invention will now be described by way of example, with reference to the accompanying drawings wherein.

DETAILED DESCRIPTION OF THE PREFERRED EMBODIMENTS OF THE INVENTION

Figure 1:
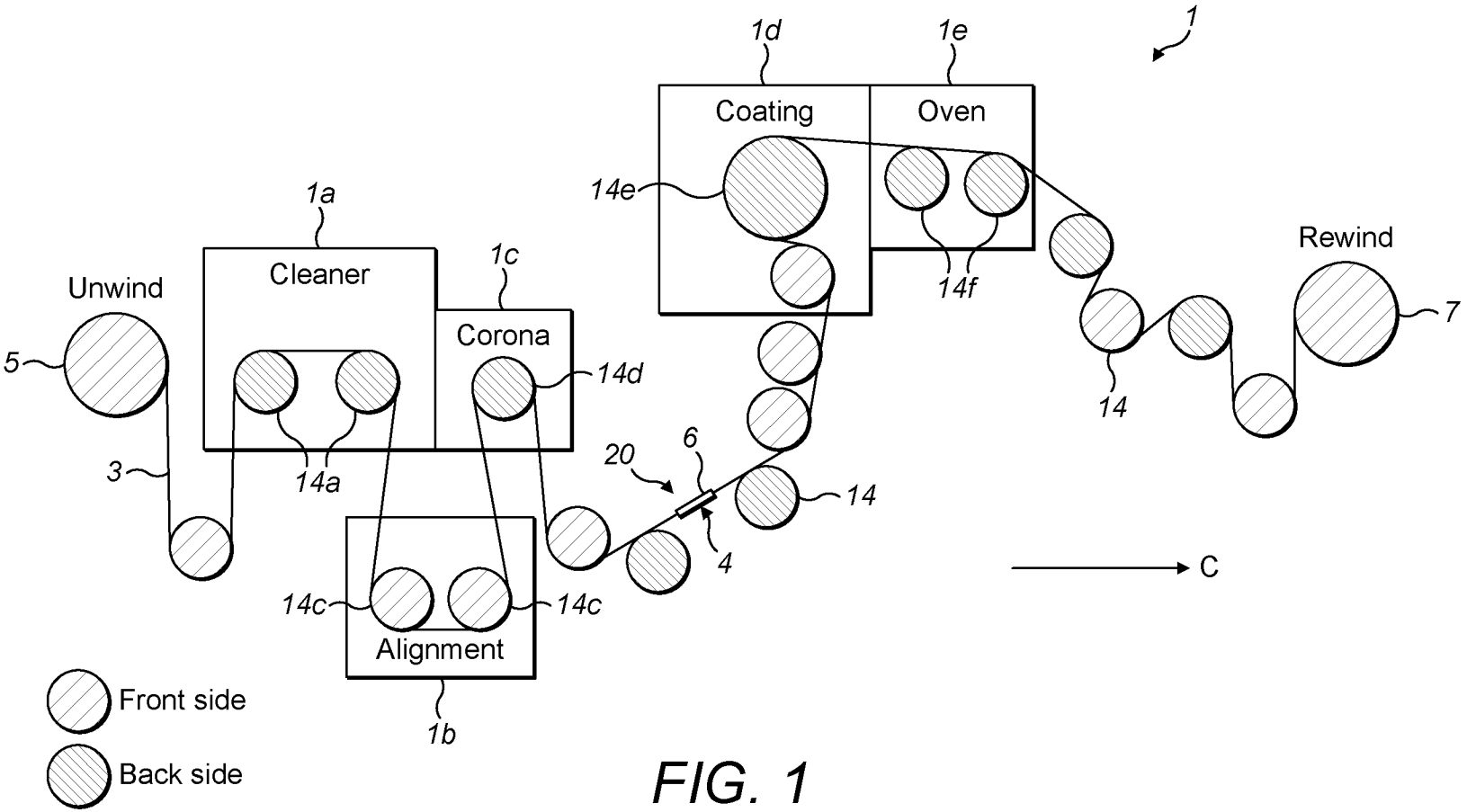
FIG. 1 is a side view of a first embodiment of a coating line cleaning apparatus in accordance with the present invention, the first embodiment of the cleaning apparatus being shown located within a multi-roller coating line.

Referring first to FIG. 1, there is shown a coating line 1 having multiple processing stations 1*a*, 1*b*, 1*c*, 1*d*, 1*e*. A web substrate 3 is pulled through the coating line 1 from an unwind roll 5 to a rewind roll 7 over a series of offset supporting rollers 14 of varying diameters and surface materials. The supporting surfaces of the rollers 14 support the web substrate 3 as it passes through the coating line 1. The roller surfaces of each roller 14 in the coating line will contact either the front side of the web substrate 3 or the back side of the web substrate 3. The web substrate 3 travels through multiple planes as it is conveyed through the coating line 1 from the unwind roll 5 to the rewind roll 7. The web substrate 3 is pulled through the coating line 1 by a pull roller (not shown) located proximate the rewind roller 7. By pulling the web substrate through the coating line 1, the web 3 is placed under tension as it passes over the surface of each of the rollers 14.

Each station within the coating line 1 has a function within the coating line. In the depicted embodiment, station 1*a* is a surface cleaning station comprising contact cleaning apparatus having cleaning rollers 14*a*. Station 1*b* is a web alignment station comprising alignment rollers 14*c* and station 1*c* comprises rollers 14*d*, typically having a ceramic surface. Station 1*d* is a substrate web 3 coating station comprising rollers 14*e* and 1*e* is an oven in which transport rollers 14*f*. Various of the rollers 14 may have a dimpled PTFE surface and act as tension rollers within the coating line. Such tension rollers apply friction forces to the substrate web 3 and, due to the slip of web material over the rollers, contaminants build up on the surface of the rollers 14.

During operation of the coating line 1, contaminants build up on the surfaces of the rollers 14, 14*a*, 14*c*, 14*d*, 14*e*, 14*f*. Such contamination will be transferred to the surfaces of the substrate web 3 unless removed by cleaning.

In-line cleaning of the coating line is made possible by the cleaning apparatus of the present invention.

As depicted in FIG. 1, a cleaning apparatus 20 for use in cleaning the rollers 14 of a coating line 1. The cleaning apparatus 20 comprises a conveyed entity 4 in the form of the flexible web 3 of filmic substrate material in the proximity of a cleaning element 6 in the form of a rectangular sheet of polyurethane 12 (see FIG. 2) is releasably adhered by surface adhesion forces to the front side 8 of the conveyed entity 4 and is arranged to be in contact with the rollers 14 of the coating line 1. The rectangular sheet 12 is flexible and is of greater length than the circumference of at least one roller 14 such that as the rectangular sheet 12 passes over the surface of each roller 14, the entire surface of each roller 14 comes into contact with the tacky polyurethane surface of the rectangular sheet 12.

Figure 2:
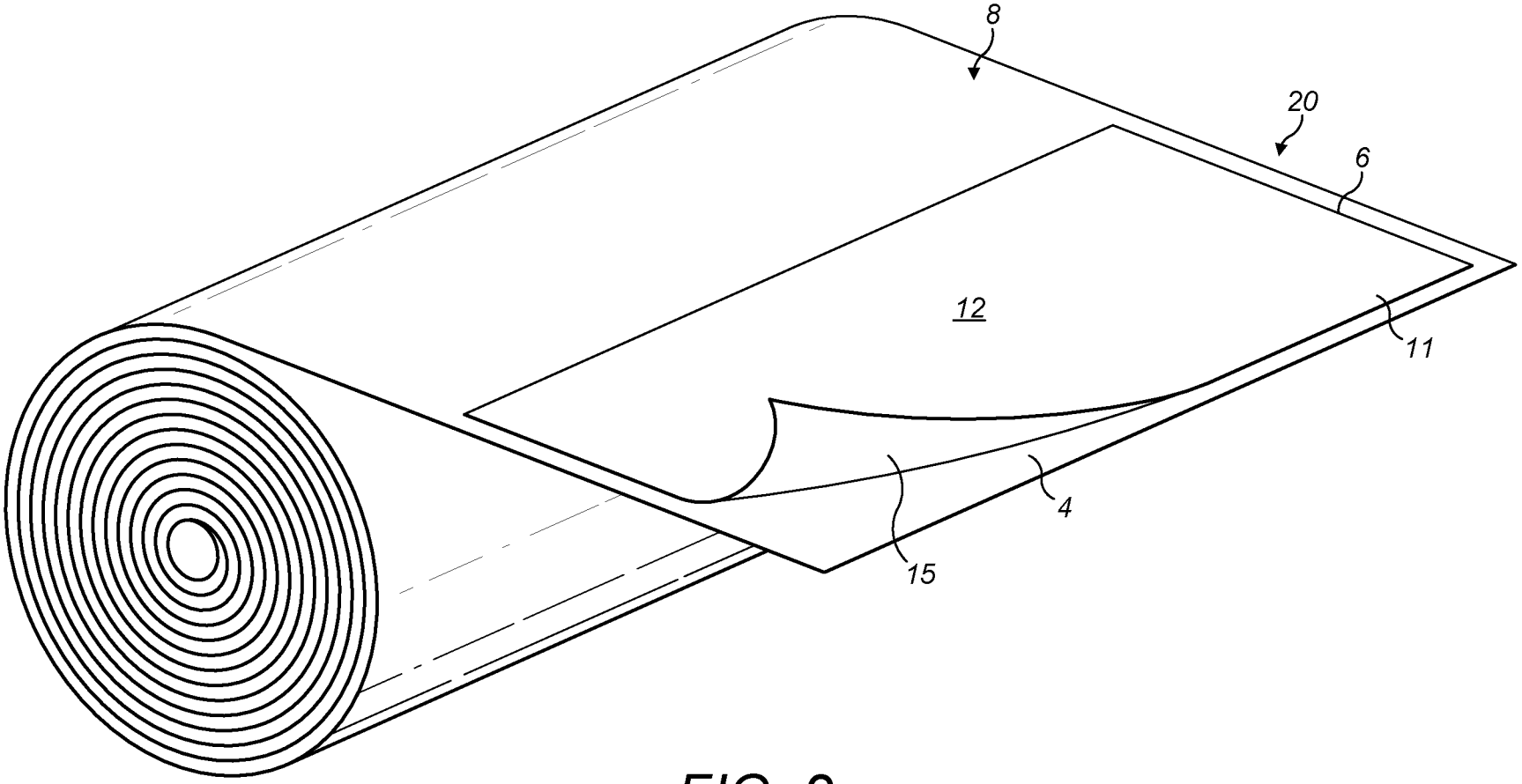
FIG. 2 is a perspective view of a cleaning apparatus in accordance with an embodiment of the present invention, a single cleaning element being shown located on the upper major face of a web substrate conveyed entity and having a corner of the cleaning element lifted away from the major face of the web substrate.

The cleaning apparatus 1 of FIG. 1 is shown in FIG. 2 without the coating line. In this embodiment, the cleaning apparatus 20 comprises a single flexible rectangular sheet of polymer 12, the first tacky major face 15 of which is releasably adhered by surface adhesion forces, such as van der Waals forces, to the first major surface 8 of a flexible web 4 of material to be coated so forming the cleaning apparatus 20. The flexible nature of the rectangular sheet 12 ensures a greater area of contact of the tacky second surface 11 of sheet 12 over the surface of the rollers in a coating line. The surface adhesion forces between major face 15 of sheet 12 and surface 4 of the web and retaining the sheet 12 in contact with the surface 4 of the web material are greater than the surface adhesion forces between the second major face 11 of sheet of polymer 12 and the surface of each roller 14 of the coating line (see FIG. 1). This ensures the cleaning apparatus remains intact through the entire coating line. The surface adhesion forces between the sheet 10 and the contaminants on the surface of each roller 14 of the coating line is greater than the adhesion forces between the contaminants and the surface of the roller 14. In this way, contaminants are removed from the surface of each roller 14 as the sheet 12 passes in temporary contact with the surface of each roller 14. In FIG. 2, a corner of sheet 12 is shown lifted away from the conveyed entity surface of the web 4 so show that the sheet 12 is releasably adhered to the conveyed entity 4.

Figure 3:
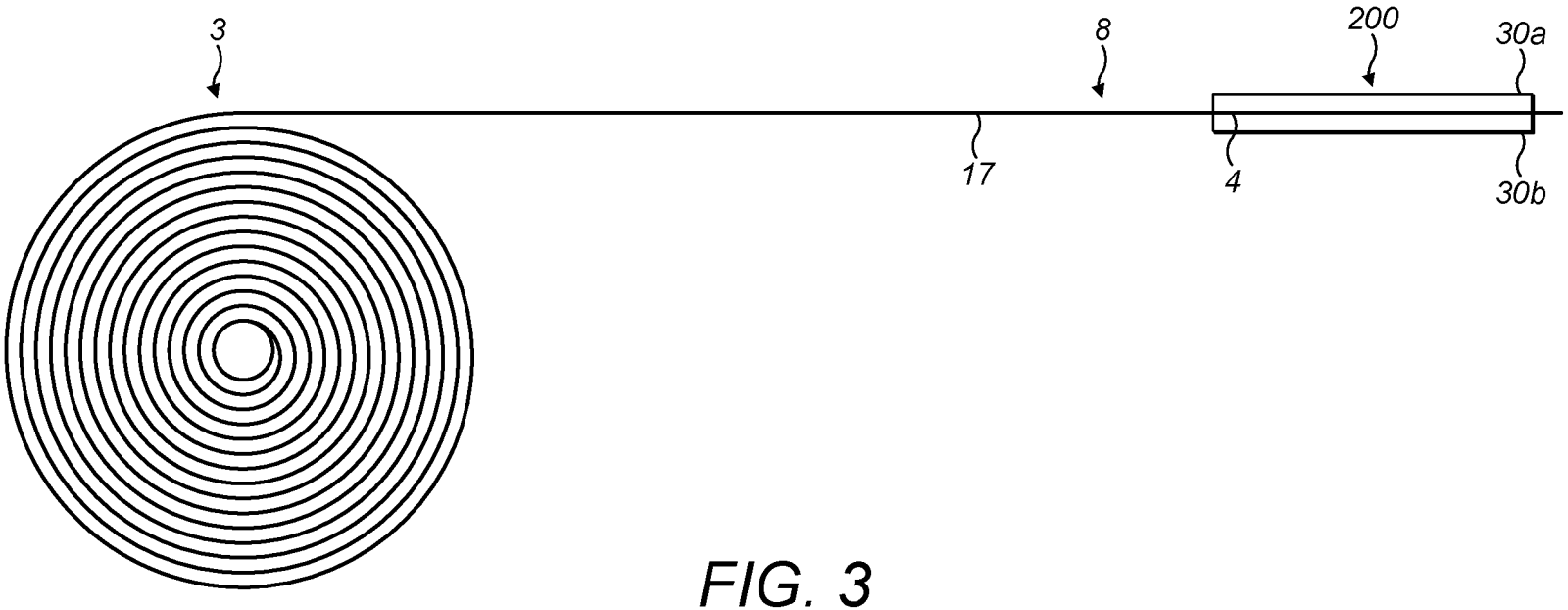
FIG. 3 is a perspective view of a cleaning apparatus in accordance with an alternative embodiment of the present invention, with two cleaning elements being shown located on mutually opposing major faces of a web substrate conveyed entity.

The alternative embodiment of the cleaning apparatus 200 shown in FIG. 3 comprises two cleaning elements 30*a* and 30*b* each in the form of a rectangular sheet of isoprene polymer. One cleaning element 30*a* is releasably adhered by surface adhesion forces to the front side 8 of a substrate web 3 in the region of conveyed entity substrate web 4 and the other cleaning element 30*b* is releasably adhered by surface adhesion forces to the back side 17 of a substrate web 3 in the region of conveyed entity substrate web 4 so forming cleaning apparatus 200. The cleaning apparatus 200 so formed is capable of cleaning the surface of any roller 14 in the coating line contacting the front 8 or the back side 17 of the substrate web 3.

Figure 4:
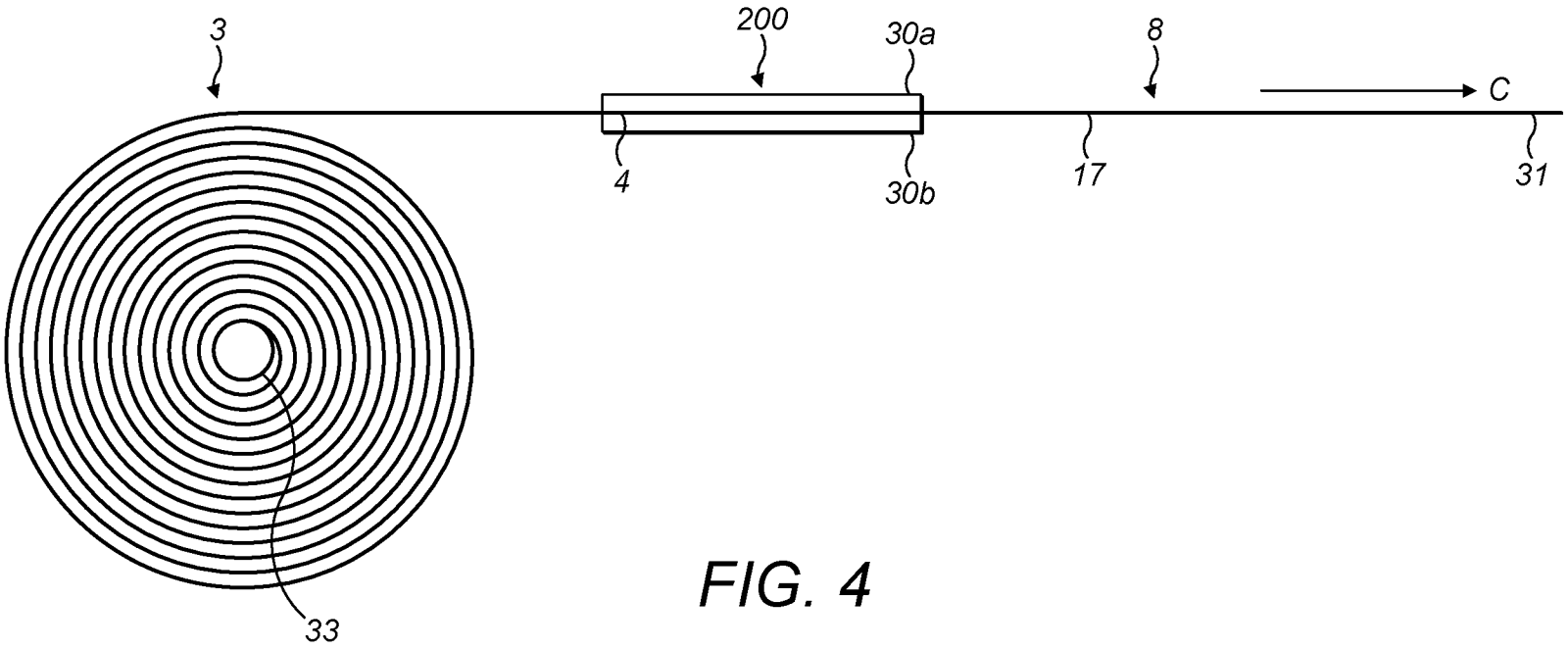
FIG. 4 is a perspective view of a cleaning apparatus in accordance with a further alternative embodiment of the present invention, with two cleaning elements being shown located on mutually opposing major faces of a web substrate conveyed entity between the leading and trailing edges of the conveyed entity.

FIG. 4 shows the cleaning apparatus 200 of FIG. 3 however the two cleaning elements 30*a* and 30*b* are located between the leading edge 31 and the trailing edge 33 of the substrate web 3. Such a cleaning apparatus 200 is operable to clean a coating line during operation of the coating line 1 and without having to shut down the coating line in order for the coating line to be cleaned.

In operation of the coating line of FIG. 1, the cleaning apparatus 20, 200 comprising a cleaning sheet 6, 30*a*, 30*b* of flexible polyurethane polymer releasably adhered by surface adhesion forces to the web substrate conveyed entity 4 is pulled through the coating line by a pull roller (not shown) located at the end of the coating line 1 proximate the rewind roll 7. The substrate web 3, including the cleaning apparatus 20, 200, is placed under tension in the coating line 1 and is conveyed into contact with the surfaces of each of the rollers 14. The surfaces of each of the rollers is cleaned by contact with the tacky surface of major face 11 of the cleaning sheet 20, 200. The rollers 14 of coating line 1 are then driven by the movement of the conveyed substrate web 3 over the surfaces of the rollers 14 in the normal conveying direction "C" in FIGS. 1 and 4. As the rectangular sheet 6 moves along the rollers 14 any dirt, dust or other contaminants on the rollers 14 is picked up by the tacky surface 11 of the rectangular sheet 6. This is due to the tackiness of the polymer 12 which picks up all loose materials on the surfaces of the rollers 14.

Once the rollers 14 have been cleaned the flexible rectangular sheet 6 may be discarded or alternatively removed and cleaned for subsequent re-use.

The present invention provides a coating line cleaning apparatus and a coating line cleaning method for removing contaminants from rollers or other supporting elements of a coating line in a simple and efficient manner. The cleaning apparatus and method greatly reduce the risk of contamination of the conveyed entity being conveyed through the coating line and obviate the need for manual cleaning of the rollers 14 (for example, by wiping the rollers with a cloth). The cleaning apparatus and cleaning method facilitate the cleaning of a coating line whilst the line is in operation as the cleaning element may simply be releasably adhered to the substrate material (conveyed entity) being pulled through the coating line. Once the cleaning apparatus comprising the cleaning element releasably adhered to the conveyed entity has passed through the coating line towards the rewind roll of the coating line, the cleaning element may be removed from the conveyed entity. The cleaning element may be cleaned for further use or otherwise discarded.

The cleaning element of the cleaning apparatus of the present invention may be constructed as a flexible sheet of polymer material. The tacky properties of the first and second mutually opposed major surfaces of the cleaning sheet being due to the surface adhesion forces of the polymer material. The sheets of cleaning element may be formed entirely from the polymer material and the surface adhesion forces providing the tacky surfaces may be predetermined to provide the required cleaning properties.

The invention is particularly applicable to the cleaning of rollers in a coating line supporting flexible substrate materials to be coated in the line and whose finished quality is paramount. While certain modifications and variations have been described above, the invention is not restricted thereto, and other modifications and variations can be adopted without departing from the scope of the invention as defined in the appended claims.

The invention claimed is:

1. A coating line cleaning apparatus for cleaning at least a selected part of a coating line, comprising a conveyed entity having first and second mutually opposed major faces and at least one flexible cleaning element having first and second mutually opposed major faces, said cleaning element being characterised in that each one of said first and second major faces is tacky, the first of said tacky faces of said cleaning element being releasably adhered to one of the major faces of the conveyed entity, and the second tacky major face of said cleaning element being temporarily contactable with the selected part of the coating line to bring said second tacky major face of the cleaning element into temporary contact with said selected part of a coating line to cause any contaminants present on said selected part of a coating line to adhere to said second tacky major face of said cleaning element thereby causing any contaminants to be removed from said selected part of a coating line, wherein the cleaning element is releasably adhered to the first or the second major face of the conveyed entity, and wherein the cleaning element is releasably adhered to the conveyed entity by adhesion forces, such that there is no adhesive material on or between the cleaning element and the conveyed entity.

2. The coating line cleaning apparatus according to claim 1, wherein the surface adhesion forces between the first tacky surface of the cleaning element and the major face of the conveyed entity are greater than the surface adhesion forces between the second tacky surface of the cleaning element and the selected part of the coating line.

3. The coating line cleaning apparatus according to claim 1, wherein the surface adhesion forces between the first tacky surface of the cleaning element and the major face of the conveyed entity are greater than the surface adhesion forces between the second tacky surface of the cleaning element and the selected part of the coating line to be cleaned by the cleaning apparatus.

4. The coating line cleaning apparatus according to claim 1, wherein the surface adhesion properties of the first and second tacky surfaces of the cleaning element are provided by one or more of mechanical adhesion forces, chemical adhesion forces, shore hardness and/or electrical adhesion forces.

5. The coating line cleaning apparatus according to claim 1, wherein the cleaning element is made from or comprises elastomer material.

6. The coating line cleaning apparatus according to claim 1, wherein the cleaning element is made from or comprises any one of: polyurethane, silicon-free polymer, hydrogel polymer, isoprene, polyvinylchloride or a silicon-based polymer.

7. The coating line cleaning apparatus according to claim 1, wherein the conveyed entity comprises a flexible substrate material.

8. The coating line cleaning apparatus according to claim 7, wherein the substrate material is a web of flexible material.

9. The coating line cleaning apparatus according to claim 1, wherein the cleaning element is releasably adhered to a portion of the conveyed entity.

10. The coating line cleaning apparatus according to claim 9, wherein the cleaning element is releasably adhered to a major face of the conveyed entity proximate a leading edge of the conveyed entity.

11. The coating line cleaning apparatus according to claim 10, wherein a cleaning element is releasably adhered to a major face of the conveyed entity remote from the leading edge of the conveyed entity.

12. The coating line cleaning apparatus according to claim 1, wherein the cleaning element is releasably adhered to a portion of the first major face of the conveyed entity.

13. The coating line cleaning apparatus according to claim 1, wherein the cleaning element is releasably adhered to a portion of the second major face of the conveyed entity.

14. The coating line cleaning apparatus according to claim 1, wherein a cleaning element is releasably adhered to a portion of the first major face of the conveyed entity and a further cleaning element is releasably adhered to a portion of the second major face of the conveyed entity.

15. The coating line cleaning apparatus according to claim 1, wherein the cleaning element is a sheeted material.

16. The coating line cleaning apparatus according to claim 1, wherein the, or each, cleaning element is releasably adhered to and is supported by the conveyed entity.

17. The coating line cleaning apparatus according to claim 1, wherein the selected part of the coating line comprises a supporting surface of at least one supporting element.

18. The coating line cleaning apparatus according to claim 17, wherein the at least one supporting element is a rotatable roller.

* * * * *